US005775440A

United States Patent [19]

Shinma

[11] Patent Number: 5,775,440

[45] Date of Patent: Jul. 7, 1998

[54] HAMMER DRILL WITH AN IDLING STRIKE PREVENTION MECHANISM

[75] Inventor: Yasutoshi Shinma, Anjo, Japan

[73] Assignee: Makita Corporation, Anjo, Japan

[21] Appl. No.: 696,504

[22] Filed: Aug. 14, 1996

[30] Foreign Application Priority Data

Aug. 18, 1995 [JP] Japan ..... 7-210863

[51] Int. Cl.[6] ..... B25D 11/06

[52] U.S. Cl. ..... 173/109; 173/201

[58] Field of Search ..... 173/104, 109, 173/200, 201, 117, 118, 204, 48

[56] References Cited

U.S. PATENT DOCUMENTS

| | | | |
|---|---|---|---|
| 4,567,951 | 2/1986 | Fehrle et al. | 173/201 |
| 4,719,976 | 1/1988 | Bleicher et al. | 173/201 |
| 4,932,479 | 6/1990 | Pyatov | 173/200 |
| 5,111,890 | 5/1992 | Ranger et al. | 173/104 |
| 5,435,397 | 7/1995 | Demuth | 173/201 |

FOREIGN PATENT DOCUMENTS 62-174887 6/1987 Japan .

*Primary Examiner*—Scott A. Smith

*Attorney, Agent, or Firm*—Lahive & Cockfield, LLP

[57] ABSTRACT

A hammer drill has an aluminum cylinder non-rotatably mounted in a crank housing, a synthetic resin slide sleeve, and a tool holder. The latter two members are coaxially fitted over the front part of the cylinder. The slide sleeve is a cylindrical member slidably mounted between a large bore portion of the tool holder and the cylinder. A steel ring is mounted at the rear of the slide sleeve. The slide sleeve and the steel ring are urged in the forward direction by a compression spring interposed between a bevel gear and the steel ring. A first air chamber which is formed in the cylinder includes a plurality of air ports which are covered by the steel ring when the slide sleeve and steel ring are pushed in their respective rear positions by pressing a tool bit attached to the hammer against a work piece. A plurality of wide and narrow slits are formed in the front portion of the slide sleeve while a plurality of air passage holes are also formed in the large bore portion of the tool holder.

6 Claims, 8 Drawing Sheets

HAMMER DRILL WITH AN IDLING STRIKE PREVENTION MECHANISM

BACKGROUND OF THE INVENTION

1. Field of the Invention

The present invention relates generally to a hammer drill, and, more particularly, relates to a hammer drill having a mechanism for preventing idling strikes.

2. Description of the Prior Art

Various configurations for preventing useless, idling strikes in an electric hammer have been proposed to improve the operability of hammer drills. One such example is disclosed in Japanese Utility Model Registration Laying-Open Gazette No. S62-174887, in which the electric hammer includes a tool bit, a cylinder containing a reciprocating piston and a striking member for being pneumatically interlocked with, and actuated by, the piston across an air chamber, and a slide sleeve fitted around the cylinder and urged forward in such a manner as to be slidable in the axial direction. In the normal operation of this electric hammer, the tool bit, pressed against a work piece, is retracted in a rear position. The retracted tool bit in turn pushes the slide sleeve backward, closing air holes provided in the cylinder for placing the air chamber in communication with the outside of the cylinder. This closure creates in the air chamber an air spring necessary to transmit impacts to the striking member and eventually the tool bit. In the idling operation of the hammer drill, on the other hand, when the tool bit is thrust in a forward position, the slide sleeve is also advanced by the forward urge to uncover the air holes, so that the effect of the air spring is lost, breaking the pneumatic interlock between the piston and the striking member.

Useful as it is in a non-rotary electric hammer, this configuration is not applicable to a hammer drill with a rotatable tool bit because the rotation of the cylinder cannot be transmitted to the tool holder due to the presence of the sleeve between the cylinder and the tool holder.

As a mechanism for preventing idle strikes in a hammer drill with a rotatable tool bit, Japanese Patent (PCT) Application Laying-Open Gazette No. H4-500043 discloses a cylinder configured for being slidably and rotatably driven by a motor. The cylinder is urged in the direction of the tool bit. Air holes in the cylinder are covered or uncovered with the inner wall of the casing of the hammer according to the position of the cylinder to either attain or lose an air spring in the air chamber. This configuration eliminates the necessity for a slide sleeve as in the previous example, and therefore enables the tool holder to rotate as well as drill.

In this configuration, however, the cylinder is not only reciprocated to attain the air spring effect in the air chamber but also it has to be rotated to in turn rotate the tool holder and the tool bit attached thereto. To perform these two separate functions, the cylinder must be made of iron or some other sturdy material to assure a high strength thereof. This, however, results in an increased cost and weight of the entire apparatus.

SUMMARY OF THE INVENTION

It is accordingly an object of the present invention to provide a hammer drill with a rotatable tool holder an idling prevention mechanism employing a slide sleeve.

It is another object of the present invention is to provide a light-weight, low-cost idling prevention mechanism applicable to a hammer drill with a rotatable tool holder.

The above and other related objects are attained by the present invention, which provides a hammer drill comprising a motor for providing drive power for the hammer drill, a cylinder fixed in a housing, a tool holder coaxially fitted around the cylinder for holding a tool bit in the front thereof, a piston reciprocably mounted in the cylinder, a striking member reciprocably mounted in the cylinder in front of the piston for imparting hammer blows to the tool bit held in the tool holder, an air chamber formed between the piston and the striking member in the cylinder for pneumatically actuating the striking member so that the reciprocating motion of the piston can be transmitted to the striking member, a rotation transmission mechanism for transmitting the rotation of the motor to the tool holder so as to rotate the tool holder, at least one air port formed in the peripheral wall of the air chamber for pneumatically communicating the inside of the air chamber with the outside of the cylinder, and an axially movable cylindrical slide sleeve urged in the forward direction by urging means. The slide sleeve is pushed backward together with the tool bit so as to covering the at least one air port in the peripheral wall of the air chamber during the normal operation of the hammer drill. Furthermore, the slide sleeve is moved forward by the urging means and uncovering the at least one air port during the idle operation of the hammer drill, thereby terminating the pneumatic actuation of the striking member.

In one aspect of the present invention, the slide sleeve is mounted between the cylinder and the tool holder.

In accordance with the present invention, each of the cylinder, the slide sleeve, and the tool holder can have at least one air vent formed therein for venting air in the cylinder in front of the striking member to the outside of the tool holder.

Preferably, the urging means is a compression spring mounted at the rear of the slide sleeve.

The hammer drill may have two or more air ports equally spaced around the peripheral wall of the air chamber.

The hammer drill in accordance with the present invention may further comprise an intermediate member interposed between the striking member and the tool bit for relaying hammer blows from the striking member to the tool bit.

The slide sleeve can have an inwardly extending flange at the front end thereof which abuts against the front end of the cylinder when the slide sleeve, pushed backward together with the tool bit, covers the air ports formed in peripheral wall of the air chamber.

In accordance with the present invention, the cylinder is preferably made of aluminum.

BRIEF DESCRIPTION OF THE DRAWINGS

For a fuller understanding of the nature and objects of the present invention, reference should be made to the following detailed description and the accompanying drawings, in which.

DETAILED DESCRIPTION OF THE PREFERRED EMBODIMENTS

Figure 1:
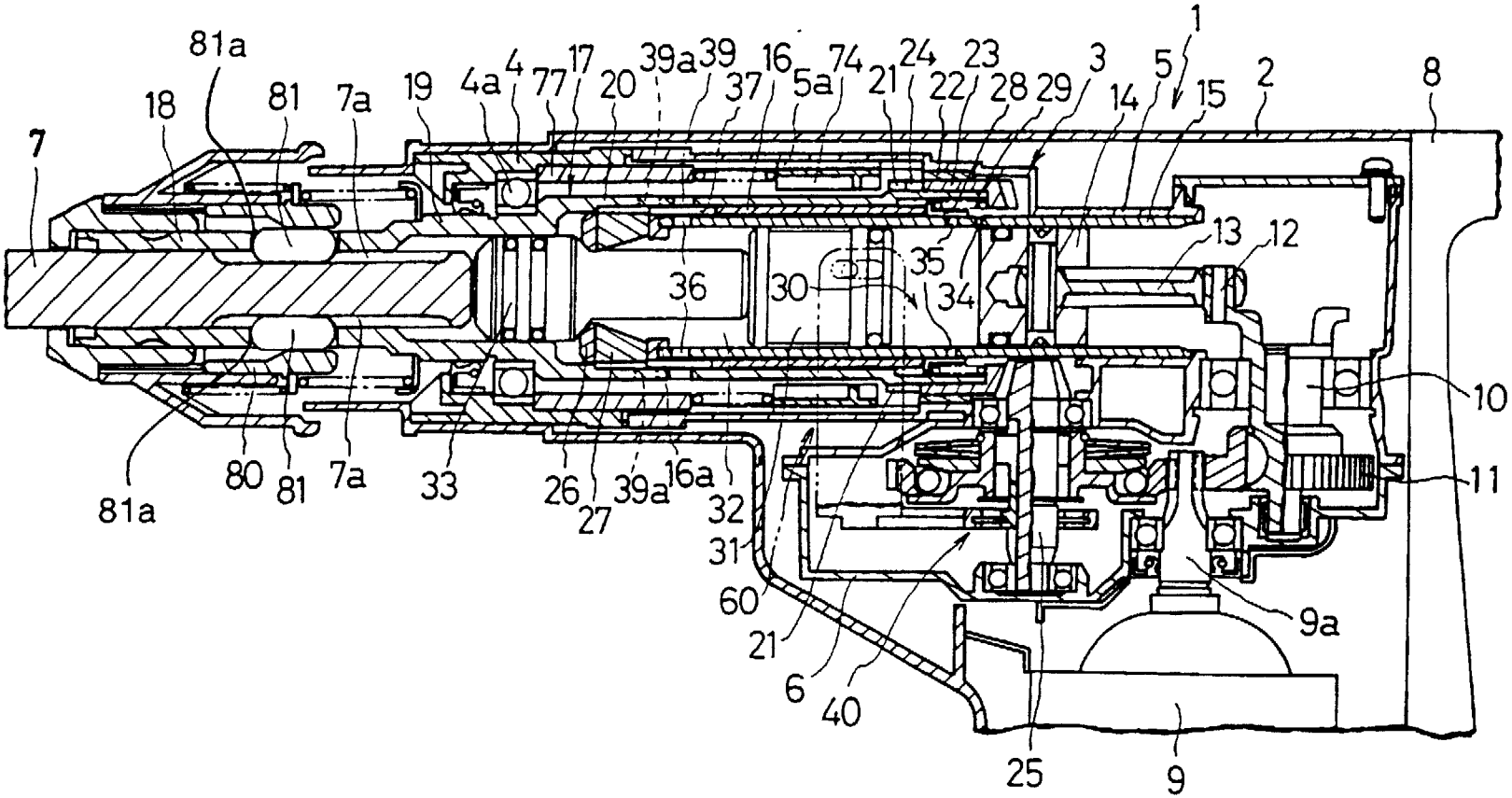
FIG. 1 is a vertical sectional view of a hammer drill embodying the present invention.

FIG. 1 depicts a vertical sectional view of a hammer drill 1 constructed according to the present invention. The hammer drill 1 comprises a housing 2, a housing cap 4, an operation mechanism 3 supported by a crank housing 5 fastened to the housing cap 4 with screws (not shown), and a transmission mechanism 40 supported by a crank housing 5 and a gear housing 6 for transmitting the rotation of a motor 9 to the operation mechanism 3. The hammer drill 1 further has between the transmission mechanism 40 and the operation mechanism 3 a change-over mechanism 60 with which to select one of an hammer only mode, a manual rotation mode, and a rotation plus hammer mode.

The operation mechanism 3 will now be explained in detail. In the following description, the direction toward the tool bit 7 is referred to as the front, the direction toward a handle 8 the rear, the top of the hammer 1 as seen in FIG. 1 upper, and the bottom of the hammer 1 as seen in FIG. 1 lower.

The motor 9 (not part of the operation mechanism 3), located at the lower rear of the crank housing 5, has a vertically oriented motor shaft 9*a* engaged with a gear 11 formed integrally with a crank shaft 10. An eccentric pin 12 projects from the top of the crank shaft 10 and penetrates one end of a connecting rod 13 of a piston 14, thereby connecting the motor 9 with the piston 14 for converting the rotation of the motor shaft 9*a* to the reciprocating motion of the piston 14. As shown in cross section in FIG. 1, the crank shaft 10 has a hollow therein with an opening at the top thereof to reduce the weight of the hammer drill 1.

An aluminum cylinder 15, encasing the piston 14, is gripped by and secured to the crank housing 5 in the rear portion, extending therefrom toward the tool bit 7. A slide sleeve 16 and a tool holder 17 are coaxially fitted around the front portion of the cylinder 15. The tool holder 17 is composed of a top small bore portion 18, into which the tool bit 7 is inserted, a middle bore portion supported by a ball bearing 4*a* provided on the housing cap 4, and a large bore portion 20 fitted with the slide sleeve 16. The small bore portion 18 protrudes forward out of the housing 2. A pair of rollers 81 are held in retaining holes 18*a* formed in the small bore portion 18 further forward from the front end of the housing 2. The rollers 81 are held in place with a chuck sleeve 80 fitted around the small bore portion 18 and engaged with a pair of the grooves 7*a* formed in the tool bit 7 so that the tool bit 7 is rotatable with the tool holder 17. On the other hand, a plurality of protrusions 21 formed on the large bore portion are engaged with a plurality of teeth 24 of a bevel gear 23 which is in turn engaged with a shaft 25 and supported by a metal support 22. This construction allows the rotation of the motor 6 to be transmitted to the tool holder 17 via the transmission mechanism 40, rotating the tool holder 17 when rotation is required.

The slide sleeve 16 is a synthetic resin tube slidably mounted between the large bore portion 20 of the tool holder 17 and the cylinder 15. The slide sleeve 16 has an inwardly extending flange 16*a* at its front end for preventing the sleeve 16 from sliding any further backward than the position shown in FIG. 1, upon abutting against the front end of the cylinder 15. A washer 26 and a rubber ring 27 are slidably interposed between the flange 61*a* and the middle bore portion 19. The washer 26 can advance as far as the step separating the middle bore portion 19 from the large bore portion 20. A compression spring 29 is interposed between the bevel gear 23 and the rear end of the slide sleeve 16, urging the slide sleeve 16 in the forward direction. A steel ring 28 is positioned between the compression spring 29 and the slide sleeve 16 around the cylinder 15.

Figure 2:
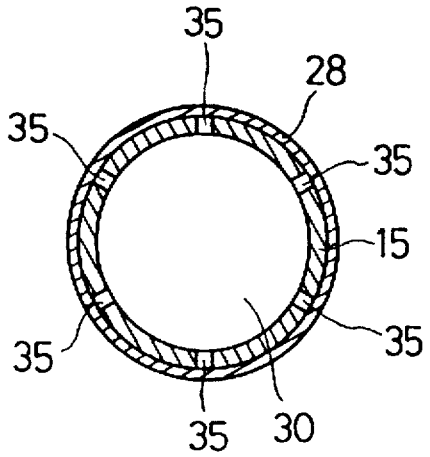
FIG. 2 is a cross sectional view of a cylinder and a steel ring fitted over a first air chamber of the hammer drill in accordance with the embodiment shown in FIG. 1.
Figure 3:
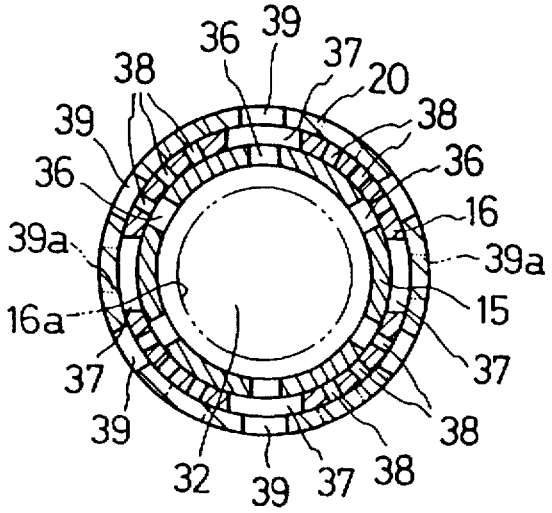
FIG. 3 is a traverse sectional view of the cylinder, a slide sleeve, and a tool holder fitted over a second air chamber of the hammer drill in accordance with the embodiment shown in FIG. 1.

The cylinder 15 contains a reciprocable striking member 31 in front of the piston 14, a first air chamber 30 formed between the piston 14 and the striking member 31, and a second air chamber 32 formed in front of the striking member 31. An intermediate member 22 is held reciprocable along the middle bore portion 19 with its rear portion of a reduced diameter protruding into the cylinder 15. A single air replenishment port 34 and six air ports 35 are provided in the part of the peripheral wall of the cylinder 15 where the first air chamber 30 is formed. Similarly, six air vents 36 are provided in the part of the peripheral wall of the cylinder 15 where the second air chamber 32 is formed. The air replenishment port 34 replenishes the first air chamber 30 with air during operation. The air ports 35 are covered with the steel ring 28 only when the slide sleeve 16 is in the rear position (the position shown in FIG. 2), where the flange 16*a* is abutted on the front end of the cylinder 15. Furthermore, a plurality of wide slits 37 and narrow slits 38 is axially formed in the front portion of the slide sleeve 16 as best shown in FIG. 3. Meanwhile, the large bore portion 20 of the tool holder 17 includes six air passage holes 39 around the part thereof over the air vents 36. The large bore portion 20 additionally includes six auxiliary holes 39*a* formed therein further toward the tool bit 17. As shown in FIGS. 1 and 3, the auxiliary holes 39*a* are axially displaced with respect to the air passage holes 39. The slits 37 and 38 are configured in such a manner as to be in pneumatic communication with the air vents 36 at all times wherever the slide sleeve 16 may be located between the forward and rear positions. Similarly, the air passage holes 39 and the auxiliary holes 39*a* are configured in such a manner as to remain at all times at all the time in pneumatic communication with the slits 37 and 38 regardless of their rotational positions, which are changeable as the tool holder 17 is rotated by the motor 9.

When pushed into the small bore portion 18 of the tool holder 17, the tool bit 7 comes into abutment with the intermediate member 33, which in turn pushes back the washer 26 and the rubber ring 27. Then, after the rubber ring 27 comes into abutment with the flange 16*a* of the slide sleeve 16, the slide sleeve 16 and the steel ring 28 are moved backward against the urge of the compression spring 29 to the position shown in FIG. 1. In this position, the air ports 35 are covered with the steel ring 28, when the piston 14 reciprocates, the first air chamber 30 functions as an air spring to pneumatically interlock the piston 14 with the striking member 31. As the piston 14 reciprocates in this manner, the striking member 31 imparts hammer blows to the rear end of the intermediate member 33 in the second air chamber 32, which transmits the impacts of the blows to the tool bit 17. In the mean time, the second air chamber 32 is pneumatically communicated with the outside via the slits 37 and 38 of the slide sleeve 16, and the air passage holes 39 and the auxiliary holes 39*a* of the tool holder 17. The reciprocating motion of the slide sleeve 16 or the rotation of the tool holder 17 creates in the second air chamber 32 hardly any pneumatic repulsion which causes loss of the impacts of the blows. The washer 26 and the rubber ring 27 cushion and reduce the recoil of the tool bit 7 transmitted to the rest of the hammer drill 1.

Figure 4:
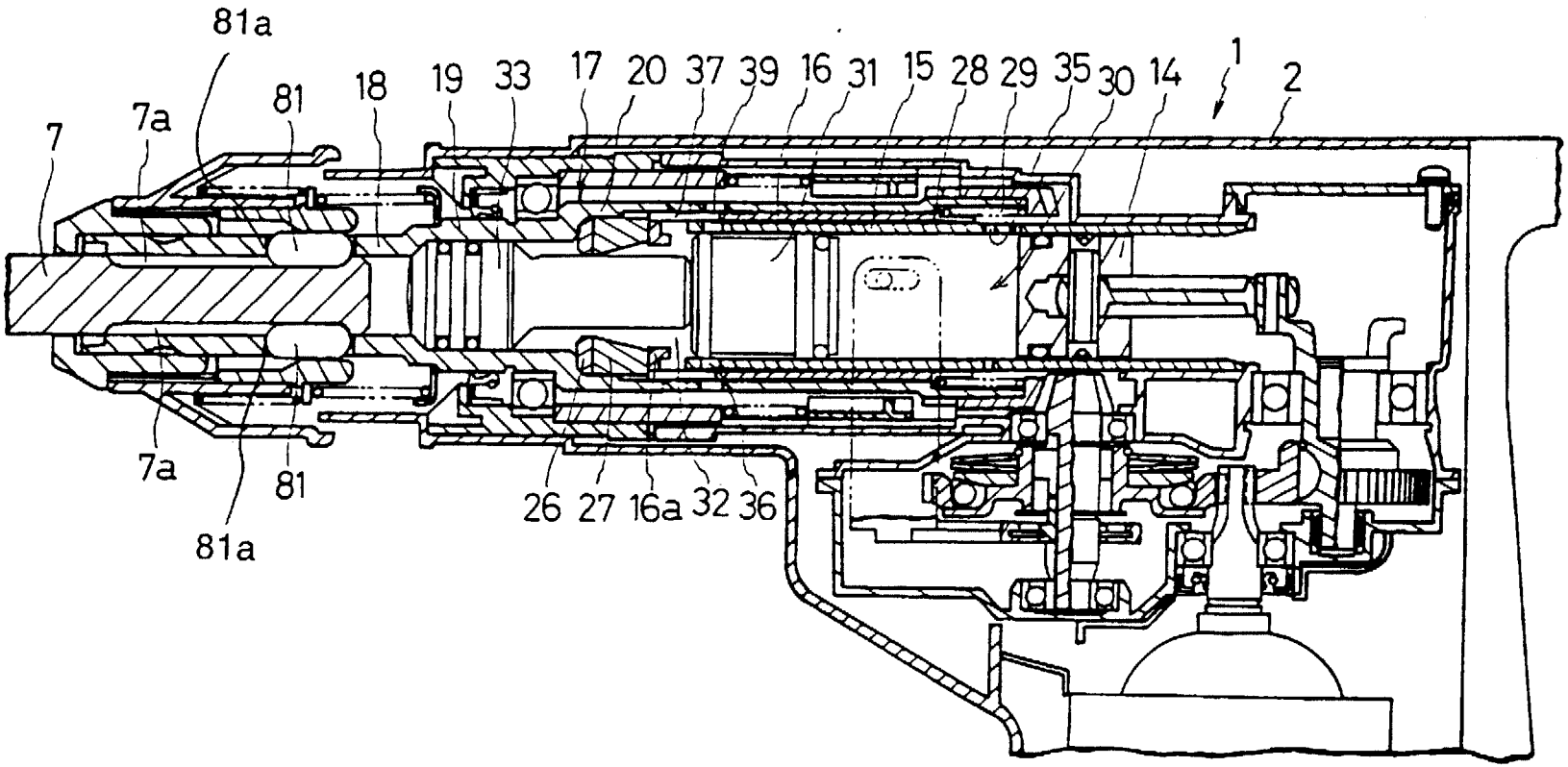
FIG. 4 is a vertical sectional view of the hammer drill shown in FIG. 1 during idling.

At the beginning of idling, when receiving a first idle blow from the striking member 31, the tool bit 7 is advanced until the end of each groove 7*a* comes to abutment with the roller 81 as shown in FIG. 4. Meanwhile, the front end of the intermediate member 33 abuts against the small bore portion 19 and the washer 26 and the rubber ring 27 abuts against the front end of the middle bore portion 19. At the same time, the slide sleeve 16 and the steel ring 28 also moves to the positions shown in FIG. 4 to uncover the air ports 35. This results in the loss of the air spring effect of the first air chamber 30 and pneumatic de-coupling of the piston 14 from the striking member 31. The striking member 31, on the other hand, comes to a stop at the rear end of the intermediate member 33 in the forward position, thereby preventing any further idle strikes. The second air chamber 32, meanwhile, is in pneumatic communication with the outside via the air vents 36, the slits 37 and 38, and the air passage holes 39 or the auxiliary holes 39*a*, eliminating any pneumatic repulsion from the second air chamber 32 that pushes back the striking member 31 toward piston 14.

As described above, the cylinder 15 is fastened inside the housing 2 while the rotatable tool holder 17 is separately provided for transmitting rotation of the motor to the tool bit 7. Furthermore, to cover and uncover the air ports 35, the operation mechanism 3 reciprocates the slide sleeve 16, which is slidably mounted between the cylinder and the tool holder 17, thereby preventing idle strikes. Due to this structure, the cylinder 15 may be made of aluminum or some other light material, hence contributing to reduced weight and cost of the hammer drill 1.

As an alternative construction, the steel ring 28 may be formed integrally with the slide sleeve 16, although these two members are formed separately in this embodiment.

Furthermore, the number and/or shapes of the air vents 36, slits 37 and 38, and/or the air passage holes 39 or the auxiliary holes 39*a* may be modified to suit specific applications.

Figure 5:
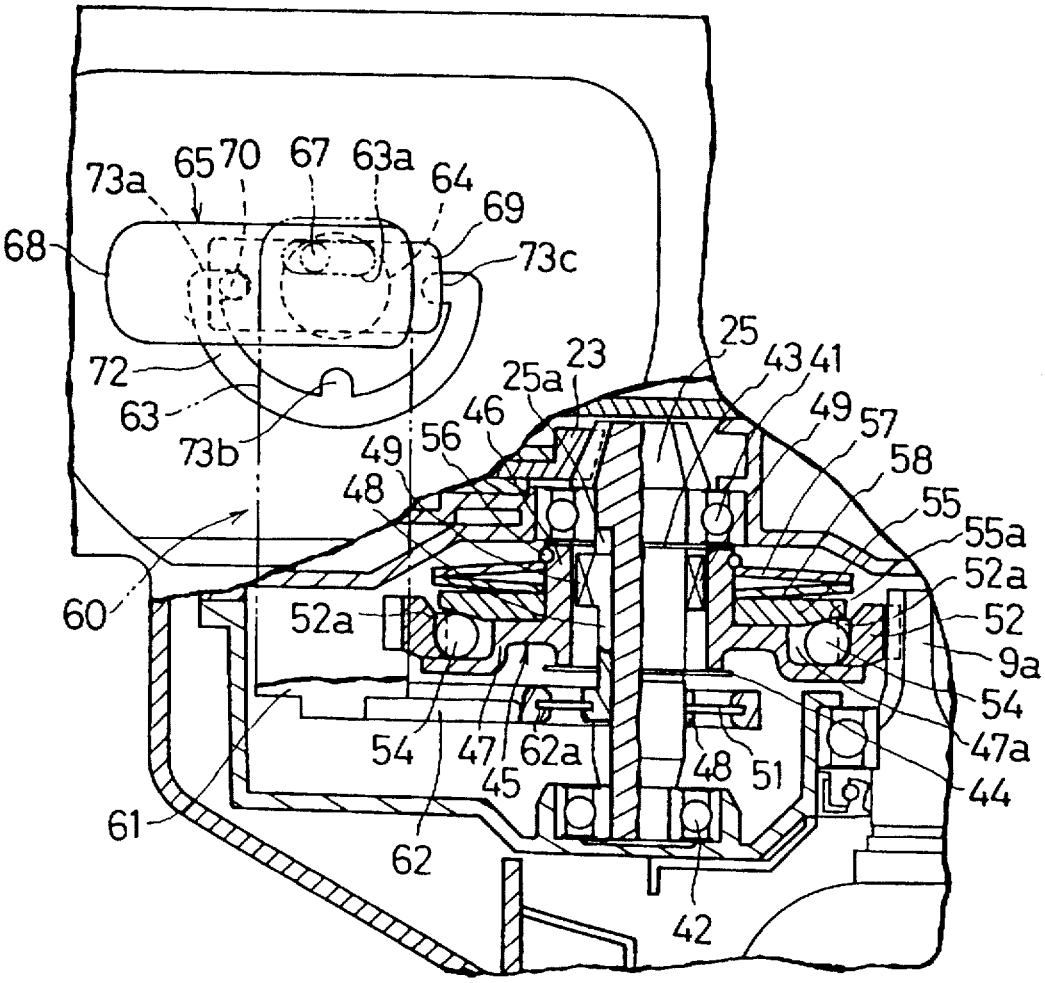
FIG. 5 is a partial cutaway sectional view of a transmission mechanism in accordance with the present invention.
Figure 6:
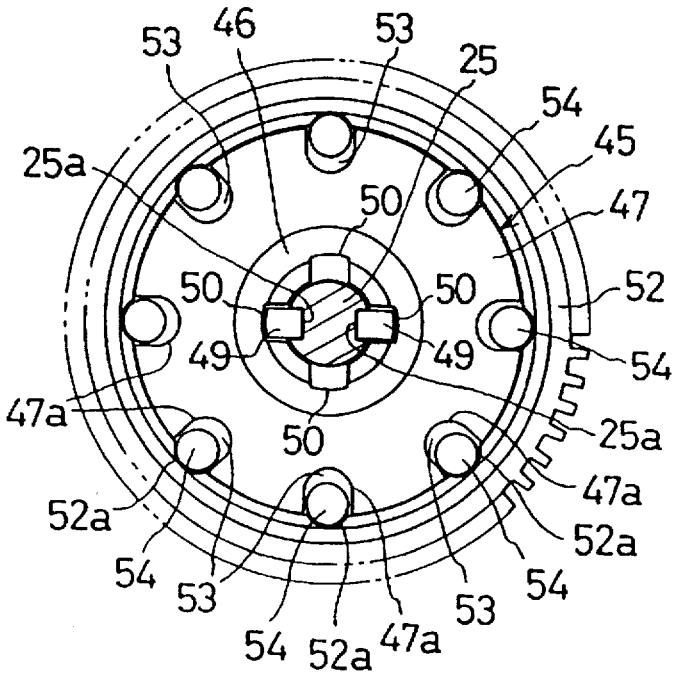
FIG. 6 is a plan view of the transmission mechanism shown in FIG. 5.

Referring now to FIG. 5, the transmission mechanism 40 will now be explained in detail. As described above, the shaft 25 is engaged with the bevel gear 23 and supported in parallel with the motor shaft 9*a* by the ball bearings 41 and 42. A sleeve 45 is rotatably mounted on the shaft 25 between washers 43 and 44, which prevent the sleeve 45 from moving vertically on the shaft 25. The sleeve 45 is composed of a cylindrical portion 46 and a flange portion 47 formed around the cylindrical portion 46. As shown in FIG. 6, the shaft 25 has a pair of diametrically opposed axial slide grooves 25*a* formed therein. A pair of change keys 48 are inserted through the washer 44 along the respective slide grooves 25*a* between the shaft 25 and the sleeve 45. Each change key 48 includes a lug 49 interposed between the washers 43 and 44, so that the vertical movement of the change keys 48 is restricted.

Figure 8:
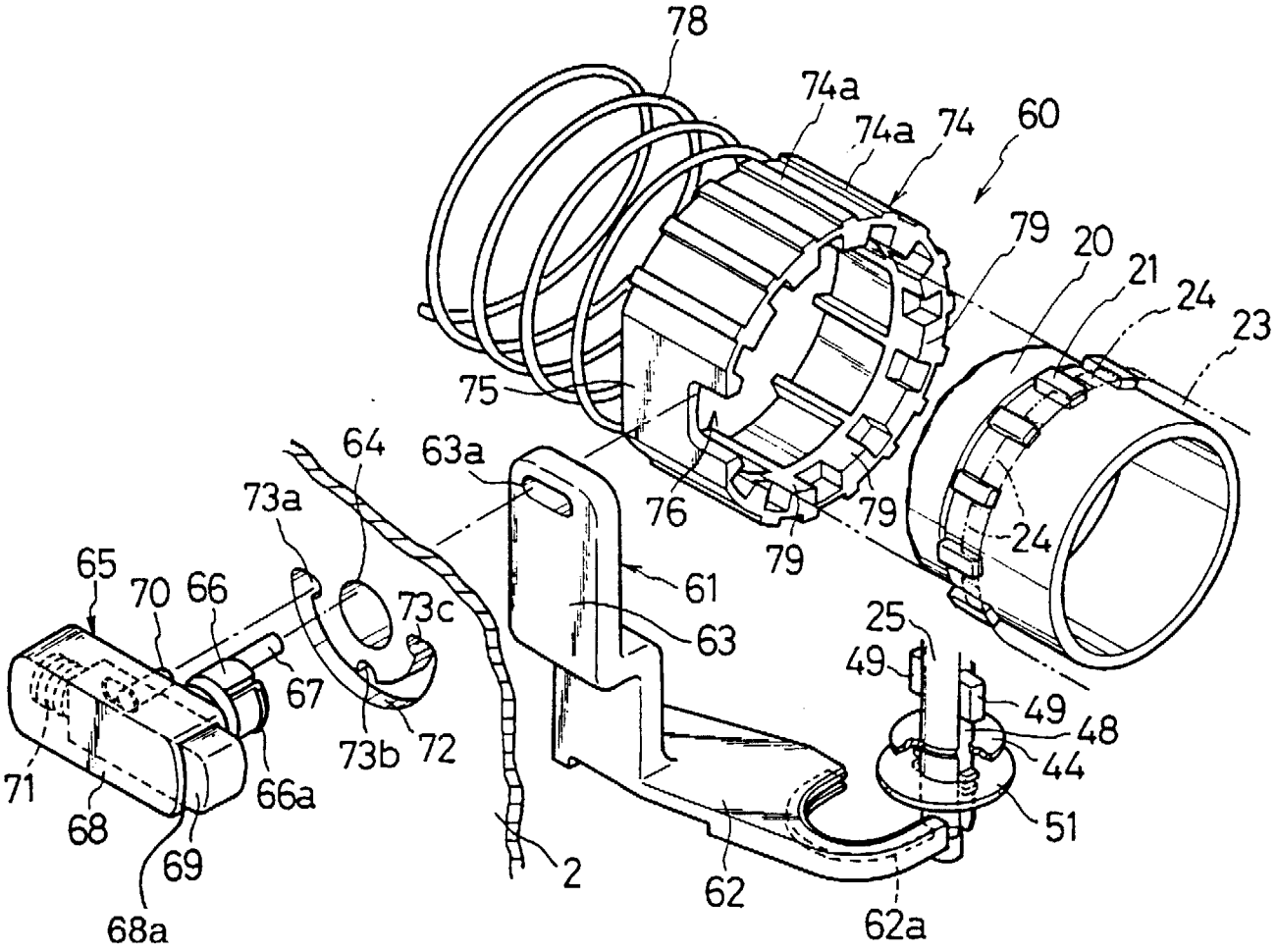
FIG. 8 is an exploded view of a change-over mechanism in accordance with the present invention.

As shown in FIG. 6, four recesses 50 are formed in the upper half of the inner wall of the cylindrical portion 46 of the sleeve 45. In the uppermost position of the change keys 48, the lugs 49 are engaged with a pair of diametrically opposed recesses 50, so that the sleeve 45 and the shaft 25 can rotates together as the sleeve 45 transmits rotation to the shaft 25. In the lowermost position of the change keys 48, on the other hand, the lugs 49 are disengaged from the recesses 50, so that the rotation of the sleeve 45 can no longer be transmitted to the shaft 25. As shown in FIGS. 5 and 8, the two change keys 48 are fastened together to the shaft 25 with a connecting ring 51 which is fitted in a groove 62*a* formed in a holder 62 of a change link 61. Thus constructed, the change keys 48 are vertically movable together with the vertical movement of the change link 61.

A helical gear 52 is coaxially mounted around the flange portion 47 and meshed with the motor shaft 9*a*. Eight equally spaced connection recesses 47*a* are formed in the circumference of the flange portion 47. Meanwhile, eight corresponding inwardly round connection surfaces 55*a* are formed on the inner surface of the helical gear 52. The connection recesses 47*a* and the connection surfaces 52*a* in combination define eight radially extending clutch grooves 53 in each of which a movable single ball 54 is placed. Mounted over the flange portion 47 formed on the cylindrical portion 46 is a shrouding ring 55 for holding the balls 54 in place. The shrouding ring 55 includes an radially tapered lower surface 55*a*. The shrouding ring 55 are downwardly urged by a pair of belleville springs 57 and 58 slipped on the cylindrical portion 46. The springs 57 and 58 are compressed and retained with a clip 56 fitted around the cylindrical portion 46 at the top end of the spring 57. The tapered surface 52*a* of the shrouding ring 55, under the pressure from the springs 57 and 58, radially urges the balls 54 in the clutch grooves 53, so that the balls 54 connect the recesses 47*a* with the connection surfaces 52*a*, thereby allowing the helical gear 52 and the sleeve 45 to rotate integrally as the motor 9 rotates. In other words, the vertical pressure exerted by the belleville springs 57 and 58 is converted into radial pressure on the balls 54 by the shrouding ring 55. Thus, the maximum torque that can be transmitted to the shaft 25 corresponds to the radial pressure exerted by the belleville springs 57 and 58.

In the operation of the transmission mechanism 40 thus constructed, when the change link 61 is in the uppermost position, the lugs 49 are engaged with two opposite recesses 50. When the motor shaft 9*a* rotates the helical gear 52 in this state, both the helical gear 52 and the sleeve 45 are rotated since the shrouding ring 55 radially urges the balls 54 in the respective clutch grooves 53 to connect the helical gear 52 and the cylindrical portion 47 of the sleeve 45. The shaft 25 is then rotated since the lugs 49 of the change keys 48 are engaged with two of the recesses 50. Subsequently, the rotation of the shaft 25 is transmitted to the bevel gear 23, thereby rotating the tool holder 17.

Figure 7:
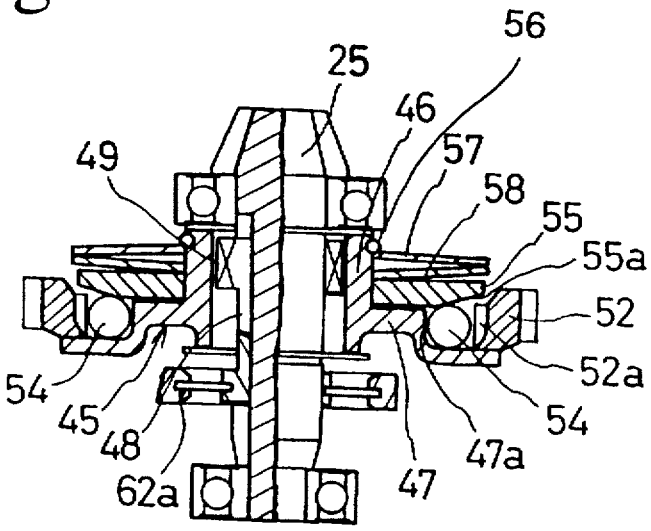
FIG. 7 is a partial sectional elevational view of the transmission mechanism shown in FIG. 5.

If the rotational resistance of the tool holder 17 exceeds the maximum transmittable torque corresponding to the pressure of the belleville springs 57 and 58 during the rotation of the tool holder 17, the balls 54 in the clutch grooves 53 are shifted toward the shaft 25 against the pressure of the shrouding ring 55, as shown in FIG. 7. This displacement of the balls 54 breaks the connection of the recesses 47*a* with the surfaces 52*a*, so that the rotation of the helical gear 52 is no longer transmitted to the flange portion 47. As should be clear from the foregoing explanation, the transmission mechanism 40 thus serves as an overload-prevention clutch. Generally, a belleville spring exhibits increasingly smaller deflection as the load approaches the elastic limit of the spring. In this embodiment, since the axial pressure of the belleville springs 57 and 58 is converted to the radial pressure using the tapered surface 55*a* of the shrouding ring 55 and the balls 54 in the clutch grooves 53, the pressure on the shrouding ring 55 can be set in the load range where the deflection of the springs 57 and 58 is small. This structure provides stable, even torque for each unit of the hammer drill 1, eliminating the need for a pressure adjustment screw and additional manufacturing steps of mounting such a screw.

It should be apparent to those skilled in the art that the number or the shapes of the belleville springs 57 and 58 or the clutch grooves 53 may be changed or modified without departing from the spirit of the present invention. Furthermore, the transmission mechanism 40 can be applied to electric tools other than the hammer drill.

Figure 9:
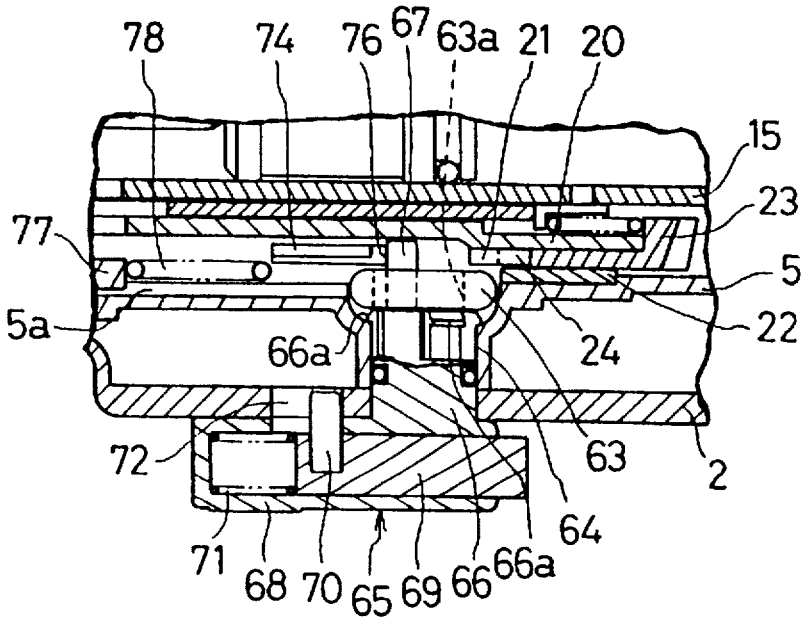
FIG. 9 is a traverse sectional plan view of the change-over mechanism shown in FIG. 8.

The change-over mechanism 60 will now be explained in detail with specific reference to FIGS. 5, 8, and 9. The change link 61 includes the holder 62 gripping the change keys 48 and a link portion 63 provided upright on the holder 62. The link portion 63 has a horizontally elongated slot 63*a* provided in the upper end thereof, which an eccentric pin 67 protruding from a mode selector switch 65 penetrates. The mode selector switch 65 includes a cylindrical portion 66, a retainer 66*a* provided on one end of the cylindrical portion 66, a box-like shaped finger grip 68 provided with an opening 68*a* on one side, a stopper 69 movably inserted into the finger grip 68, a pin 70, and a compression spring 71. The cylindrical portion 66 is rotatably inserted into a through-hole 64 formed in the housing 2 and the crank housing 5, with the retainer 66*a* maintaining the cylindrical portion 66 in place. The cylindrical portion 66 is connected to the finger grip 68 near the opening 68*a* outside the housing 2. The inserted stopper 69 is urged toward the opening 68*a* by the compression spring 71. The pin 70, orthogonally mounted on the stopper 69, penetrates a semi-circular slit 72 in the housing 2 to prevent the stopper 69 from falling out. The slit 72 is provided with three notches 73*a*, 73*b*, and 73*c* cut toward the center at both ends (0 and 180 degree positions) and the middle point (90 degree position). While the pin 70 can be guided along the slit 72, the pressure of the compression spring 71 allows the pin 70 to be engaged with and fixed in any of the notches 73*a*, 73*b*, and 73*c*.

A lock ring 74 is fitted over the large bore portion 20 of the tool holder 17. The lock ring 74 has on the periphery a plurality of pinions 74*a* for engaging axially extending teeth 5*a* formed on the inner surface of the crank housing 5. The lock ring 74 is urged backwardly by a compression spring 78 interposed between the lock ring 74 and a bearing retainer 77 mounted in the bearing cap. The lock ring 74 also has a square recess 76 formed in a chamfer 75, with which the eccentric pin 67 of the mode selector switch 65 is engaged via the slot 63*a* of the change link 61. Furthermore, a plurality of teeth 79 is formed around the inner rear circumference of the lock ring 74 for engaging the front halves of the matching protrusions 21 on the tool holder 17. FIG. 5 shows the position of the eccentric pin 67 with the pin 70 in the notch 73*a* (the 0 degree position). When the pin 70 is in the notch 73*b* (the 90 degree position), the eccentric pin 67 is moved to a lower left position. With the pin 70 in the notch 73*c* (the 180 degree position), the eccentric pin 67 is moved to a lower right position. The change link 61 and the change keys 48 are moved as the eccentric pin 67 is moved vertically in this manner. Similarly, the lock ring 74 is moved in the axial direction according to the axial movement of the change link 61 to engage or disengage the teeth 79 with the protrusions 21.

Figure 10C:
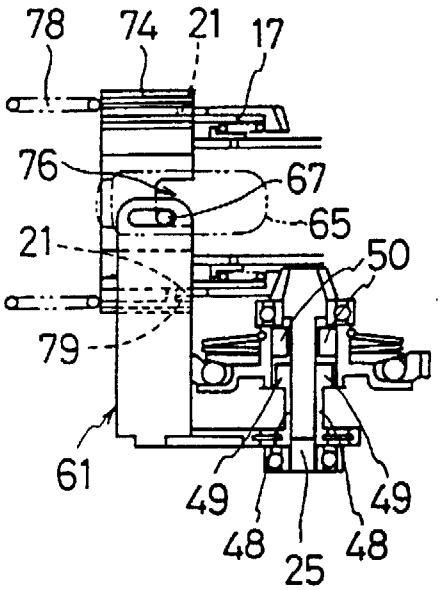
FIG. 10C shows the transmission mechanism and the change-over mechanism in the hammer only mode.

In the change-over mechanism 60 thus constructed, three operational modes can be selected by rotating the mode selector switch 65. In the 0 degree position as shown in FIG. 10A, the eccentric pin 67, located in its upper left position, leaves the lock ring 74 disengaged from the protrusions 21. At the same time, the change link 61 is located in the uppermost position, thus engaging the lugs 49 with two of the recesses 50. In this position, therefore, a rotation plus hammer mode is selected in which the piston 14, the striking member 31, and the intermediate member 33 are pneumatically actuated to impart hammer blows while the tool holder 17 is driven to rotate.

Figure 10B:
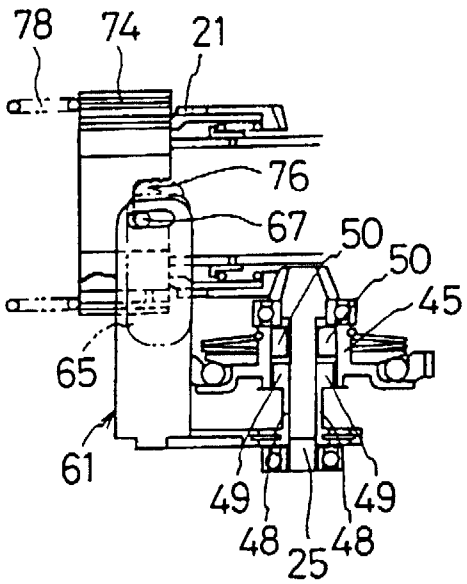
FIG. 10B shows the transmission mechanism and the change-over mechanism in the manual rotation mode.
Figure 10A:
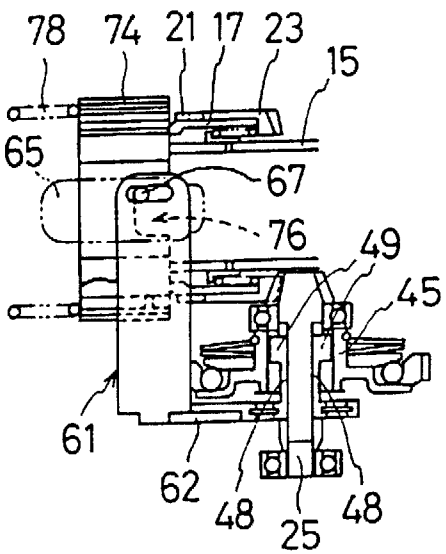
FIG. 10A shows the transmission mechanism and the change-over mechanism in a rotation plus hammer mode.

If the mode selector switch 65 is rotated counterclockwise 90 degrees as shown in FIG. 10B, the eccentric pin 67 is shifted to its lower left position, still leaving the lock ring 74 disengaged from the protrusions 21. However, the change link 61 is moved to its lowermost position. Since this disengages the lugs 49 from the two recesses 50, the rotation of the sleeve 45 is no longer transmitted to the shaft 25. In this position, therefore, hammering can still be performed while the tool holder 17, no longer driven to rotate by the motor 6, is manually freely rotatable in either direction. This operational mode is referred to as the manual rotation mode hereinafter.

If the mode selector switch 65 is rotated further counterclockwise by another 90 degrees to the 180 degree position as shown in FIG. 10C, the eccentric pin 67 is shifted to its lower right position, bringing the lock ring 74 backward into engagement with the protrusions 21 to prevent the rotation of the tool holder 17. Since the change link 61 remains in the lowermost position, the rotation of the sleeve 45 is not transmitted to the shaft 25 while hammer blows are still available. This operational mode is referred to as the hammer only mode hereinafter. As an example of the use of these modes, if the angle of the tool bit 7 to the work piece needs to be fixed, it can be easily achieved by rotating the tool holder 17 to obtain the desired angle in the manual rotation mode and then further rotating the mode selector switch 65 to place the operation in the hammer only mode, where only hammering is available without rotating the tool bit 7.

As explained above, according to the change-over mechanism 60 of the preferred embodiment, the transmission of rotation of the motor 6 to the shaft 25 and the locking of the tool holder 17 are performed by two separate members, i.e., the sleeve 45 and the lock ring 74. One of the advantages of such a construction is each of these two members can be optimally designed to withstand the specific range of load imposed on the member to achieve an increased durability. This construction is more economical than a design using a single member because, should one of the members be damaged, there is no need of replacing the other. Moreover, high operability is ensured by the efficiency of the construction in which the eccentric pin 67 is smoothly interlocked with the lock ring 74 and the change keys 48.

In the foregoing embodiment, the lock ring 74 is moved in the axial direction and the change keys 48 is moved in the direction orthogonal to the axial direction in order to effect their respective switchover functions. However, modification is possible to move the change keys 48 also in the axial direction.

According to the present invention, the transmission of rotation to the tool bit and the prevention of idle hammering blows are carried out by two separate members, namely a tool holder and a slidable cylinder, in a hammer drill. Due to this arrangement, the slidable cylinder can be made of a light material, such as aluminum, thereby reducing the weight and the cost of the hammer drill.

As there may be many other modifications, alterations, and changes without departing from the scope or spirit of essential characteristics of the present invention, it is to be understood that the above embodiment is only illustrative and not restrictive in any sense. The scope or spirit of the present invention is limited only by the terms of the appended claims.

What is claimed is:

1. A hammer drill, comprising:

a motor for providing drive power for the hammer drill;

a cylinder fixed in a housing;

a tool holder coaxially fitted around the cylinder for holding a tool bit in a front thereof;

a piston reciprocably mounted in the cylinder;

a striking member reciprocably mounted in the cylinder in front of the piston for imparting hammer blows to the tool bit held in the tool holder;

an air chamber formed between the piston and the striking member in the cylinder for pneumatically actuating the striking member so that the reciprocating motion of the piston can be transmitted to the striking member;

a rotation transmission mechanism for transmitting the rotation of the motor to the tool holder so as to rotate the tool holder;

means forming at least one air port formed in a peripheral wall of the air chamber for pneumatically communicating the inside of the air chamber with the outside of the cylinder; and an axially movable cylindrical slide sleeve urged in the forward direction by urging means, the slide sleeve being mounted between the cylinder and the tool holder, the slide sleeve being pushed backward together with the tool bit and covering the at least one air port in the peripheral wall of the air chamber during normal operation of the hammer drill, and the slide sleeve being moved forward by the urging means and uncovering the at least one air port during idle operation of the hammer drill, thereby, terminating the pneumatic actuation of the striking member;

wherein each of the cylinder, the slide sleeve, and the tool holder has at least one air vent formed therein for venting air in the cylinder in front of the striking member to the outside of the tool holder.

2. A hammer drill in accordance with claim 1, wherein the urging means comprises a compression spring mounted at the rear of the slide sleeve.

3. A hammer drill in accordance with claim 1, wherein the number of the at least one air port is at least two and the air ports are equally spaced around the peripheral wall of the air chamber.

4. A hammer drill in accordance with claim 1, further comprising an intermediate member interposed between the striking member and the tool bit for relaying hammer blows from the striking member to the tool bit.

5. A hammer drill in accordance with claim 1, wherein the slide sleeve has an inwardly extending flange at the front end thereof, the flange abutting against the front end of the cylinder when the slide sleeve, pushed backward together with the tool bit, covers the air port formed in peripheral wall of the air chamber.

6. A hammer drill in accordance with claim 1, wherein the cylinder is made of aluminum.

* * * * *